US006581307B1

(12) United States Patent
Jones et al.

(10) Patent No.: US 6,581,307 B1
(45) Date of Patent: Jun. 24, 2003

(54) WING PLOW ASSEMBLY

(75) Inventors: Jayson D. Jones, Madison, WI (US); Daniel K. Jones, deceased, late of Madison, WI (US), Jayson D. Jones, Justine Mascari, legal representatives

(73) Assignee: Burke Truck & Equipment, Inc., Madison, MI (US)

( * ) Notice: Subject to any disclaimer, the term of this patent is extended or adjusted under 35 U.S.C. 154(b) by 0 days.

(21) Appl. No.: 10/207,700

(22) Filed: Jul. 29, 2002

(51) Int. Cl.[7] ..... E01H 5/06
(52) U.S. Cl. ..... 37/281; 37/274
(58) Field of Search ..... 37/266, 280, 281, 37/274, 269, 234, 236; 172/810, 811, 815, 817

(56) References Cited

U.S. PATENT DOCUMENTS

| | | | | | |
|---|---|---|---|---|---|
| 838,200 | A | * | 12/1906 | Minier | 37/215 |
| 1,853,939 | A | * | 4/1932 | Soule et al. | 37/274 |
| 2,193,532 | A | * | 3/1940 | Frink | 37/234 |
| 2,991,566 | A | * | 7/1961 | Sumner et al. | 37/232 |
| 3,125,818 | A | * | 3/1964 | Kraft et al. | 37/236 |
| 3,659,363 | A | * | 5/1972 | Snyder | 37/231 |
| 4,045,892 | A | | 9/1977 | Farrell | |
| 4,096,652 | A | | 6/1978 | Raines et al. | |
| 4,249,323 | A | | 2/1981 | Mathis et al. | |
| 4,356,645 | A | | 11/1982 | Hine et al. | |
| 4,357,766 | A | | 11/1982 | Croteau et al. | |
| 4,596,081 | A | | 6/1986 | DeBilly et al. | |
| 4,744,159 | A | | 5/1988 | Houle | |
| 4,969,280 | A | | 11/1990 | Thorneloe | |
| 4,976,054 | A | | 12/1990 | Jones | |
| 5,031,343 | A | | 7/1991 | Houle et al. | |
| 5,148,617 | A | | 9/1992 | Feller et al. | |
| 5,285,588 | A | | 2/1994 | Niemela et al. | |
| 5,437,113 | A | | 8/1995 | Jones | |
| 5,638,618 | A | | 6/1997 | Niemela et al. | |
| 5,809,672 | A | | 9/1998 | Jones | |
| 5,819,444 | A | * | 10/1998 | Desmarais | 37/281 |
| 5,899,007 | A | | 5/1999 | Niemela et al. | |
| 6,249,992 | B1 | | 6/2001 | Irving et al. | |
| 6,408,549 | B1 | | 6/2002 | Quenzi et al. | |
| 6,412,199 | B1 | | 7/2002 | Quenzi et al. | |
| 6,412,200 | B1 | * | 7/2002 | Savard | 37/281 |

* cited by examiner

*Primary Examiner*—Thomas B. Will
*Assistant Examiner*—Kristine Florio
(74) *Attorney, Agent, or Firm*—Craig A. Fieschko, Esq.; DeWitt Ross & Stevens S.C.

(57) ABSTRACT

A wing plow assembly includes a base member for mounting to a plowing vehicle (or to structures connected to a plowing vehicle, such as on a plow frame for a front moldboard). Upper and lower height adjustment arms each have a base end pivotally anchored to the base member, and an opposing plow end pivotally linked to a plow positioning leg. The base member, height adjustment arms, and plow positioning leg form a parallelogram linkage wherein the plow positioning leg may vertically swing on the height adjustment arms about the base member. A wing plow having a length extending between a inner end and a outer end has its inner end affixed to the plow positioning leg so that the wing plow may also vertically swing about the base member, thereby allowing the wing plow to be raised and lowered with respect to the base member (and thus with respect to the plowing vehicle). Additionally, the wing plow inner end is preferably affixed to the plow positioning leg so that it may swing horizontally thereon, thereby allowing the wing plow outer end to be folded toward or away from the plowing vehicle. The wing plow inner end is affixed to the plow positioning leg (or associated structure), and a wing fold linear actuator then extends from the outer end of the wing plow to affix to the plow positioning leg (or associated structure). The wing fold linear actuator is extendible and contractible to horizontally swing the wing plow about the plow positioning leg, and thus fold the wing plow with respect to the plowing vehicle.

30 Claims, 2 Drawing Sheets

WING PLOW ASSEMBLY

FIELD OF THE INVENTION

This disclosure concerns an invention relating generally to snowplows, and more specifically to wing plows (also known as patrol wings) for snowplows.

BACKGROUND OF THE INVENTION

Snowplows such as those commonly used to plow snow from roadways, parking lots, and other areas often include a front blade (often referred to as a front moldboard or similar terms) and a side blade (often referred to as a wing plow, wing blade, patrol wing, or similar terms). The front and side blades are often provided on a removable plow frame provided at the front of the plowing vehicle, and which may be detached from the plowing vehicle during snow-free months to allow other uses for the vehicle.

Regarding the side blades (which will generally be referred to herein as "wing plows"), these generally have one of their sides hingedly mounted to the front of the plowing vehicle, and are driven by linear actuators such as hydraulic cylinders so that a wing plow may be folded up alongside (and somewhat parallel to) the plowing vehicle when not in use, and folded down to protrude along one side of the vehicle to travel along the ground when in use. Plowing with a wing plow takes practice and skill since it protrudes outwardly from the plowing vehicle by a significant distance, and the end of the wing plow can collide with objects in and alongside the road, e.g., mailboxes or vehicles in another traffic lane, if it is not withdrawn (folded to the vehicle) at the appropriate time. Difficulties in using wing plows are compounded because plowing generally occurs in conditions of low visibility (generally early in the morning during or shortly after a snowstorm), and at high speed owing to the need to rapidly enhance road safety for other motorists. The situation can be better appreciated if the reader contemplates the difficulties involved in driving a large vehicle in the dark during a snowstorm, while simultaneously listening to a radio dispatcher, steering the vehicle to appropriately orient the front moldboard, and actuating controls to adjust the positions of the wing plow and front moldboard so as to attain the desired snow removal and to avoid striking objects in and around the roadway.

These difficulties are compounded by the limited versatility of most wing plow mounts and actuation arrangements. Wing plows generally fold outwardly and downwardly from the plowing vehicle, i.e., they lift as they are folded inwardly toward a vehicle and drop when being folded outwardly. Thus, if a plow operator needs to partially fold a wing plow inwardly to avoid striking an object alongside the roadway, the wing plow may lift to such a degree that it no longer contacts the plowing surface. As a result, multiple passes with the plowing vehicle may be required to adequately remove snow from some areas. Additionally, it is generally impossible or very difficult for an operator to adjust the height of a wing plow to clear a raised area, e.g., above a curb, and when this is done the effective length (reach) of the wing plow tends to be greatly decreased.

Wing plows are also subject to greater durability and maintenance concerns than front moldboards. Like front moldboards, wing plows experience significant wear and shock as they scrape along an irregular roadway surface, and as they experience loading from snow, ice, and impact with objects in and alongside the roadway. However, since wing plows have their primary connection to the plowing vehicle at their sides, rather than at their centers (as with front moldboards), this connection is subject to significant stress owing to the moment forces generated during plowing. The connection can be reinforced, and hydraulic cylinders and/or other supports are often provided between the plowing vehicle and the outer end of the wing plow (the protruding end spaced away from the plowing vehicle) to bear a portion of the load experienced by the wing plow. While these measures strengthen the support for the wing plow, they can lead to greater maintenance burdens in the long run. When the wing plow's primary connection to the plowing vehicle (at the side of the moldboard) is reinforced, this often tends to add such bulk to the wing plow mounting arrangement that access to the plowing vehicle's hood is severely obstructed. This causes difficulties because the vehicle's hood needs to be lifted quite often during the plowing season for maintenance of the vehicle's engine, the plowing controls and hydraulics, etc., and if the plow frame and/or other wing plow mounting structure requires removal every time the vehicle hood is to be accessed, this can diminish the plowing vehicle's available operating time. Access to the hood and/or other components of the plowing vehicle can be further obstructed when supports are added between the plowing vehicle and the outer end of the wing plow, and such supports, being subject to significant stress and wear, require additional maintenance. This is particularly true if such supports include hydraulics or similar "controllable" components which are relatively complex and which are more susceptible to shock damage, and which also enhance the operational complexity of the wing plow owing to the plowing vehicle operator's need to actuate these components, along with other components of the plow, during plowing operations. Such supports also define additional connections that must be removed if the wing plow if to be removed from the plowing vehicle for maintenance or other reasons.

As a result, there is a need for arrangements whereby a wing plow's height and effective length may be adjusted by a plowing vehicle operator as desired, with such arrangements preferably being easily controllable to reduce operational complexity for the plowing vehicle operator, and also preferably being relatively structurally simple for ease of maintenance and control.

SUMMARY OF THE INVENTION

The invention, which is defined by the claims set forth at the end of this document, is directed to a wing plow assembly which at least partially alleviates the aforementioned problems. A basic understanding of some of the preferred features of the invention can be attained from a review of the following brief summary of the invention, with more details being provided elsewhere in this document.

In a preferred version of the wing plow assembly, a lifting subassembly is provided to allow vertical lifting of the entire length of a wing plow, thereby allowing the wing plow to be lifted above roadway objects, raised for plowing of curbs, etc. Initially, the wing plow assembly includes a base member for mounting to a plowing vehicle (or to structures connected to a plowing vehicle, such as on a plow frame for a front moldboard). Upper and lower height adjustment arms each have a base end pivotally anchored to the base member, and an opposing plow end pivotally linked to a plow positioning leg. The base member, height adjustment arms, and plow positioning leg form a parallelogram linkage wherein the plow positioning leg may vertically swing on the height adjustment arms about the base member. A wing plow having a length extending between a inner end and a outer end has its inner end affixed to the plow positioning leg so that the wing plow may also vertically swing about the base member. A wing lift linear actuator (e.g., a hydraulic cylinder) is provided in the parallelogram linkage such that actuation of the wing lift linear actuator raises and lowers the plow positioning leg with respect to the base member (and plowing vehicle), and thus the wing plow is also raised and lowered with respect to the base member (and plowing vehicle).

A folding subassembly is also provided to allow folding of the wing plow with respect to the plowing vehicle. The wing plow inner end is preferably affixed to the plow positioning leg so that it may at least swing horizontally thereon, thereby allowing the wing plow outer end to be swung toward or away from the plowing vehicle. This is preferably done by pivotally mounting the wing plow inner end to the plow positioning leg, as by affixing the wing plow inner end to a wing plow anchor which is horizontally rotatable about a wing positioning bar on the plow positioning leg. A wing fold linear actuator then extends from the outer end of the wing plow to affix to structure associated with the plow positioning leg (such as the wing plow anchor), and the wing fold linear actuator is extendible and contractible to horizontally swing the wing plow about the plow positioning leg (and thus fold the wing plow with respect to the plowing vehicle). To allow the wing plow to fold upwardly with respect to the plowing vehicle as well as inwardly, the wing plow inner end may also be pivotally affixed to the wing plow anchor to allow it to vertically swing thereon when the wing fold linear actuator is actuated. It is additionally possible to allow the wing plow to "float," i.e., to adapt its height to irregularities in the plowing surface, by allowing the aforementioned wing plow anchor to slide on the wing positioning bar as well as rotate about it.

Further advantages, features, and objects of the invention will be apparent from the following detailed description of the invention in conjunction with the associated drawings.

DETAILED DESCRIPTION OF PREFERRED EMBODIMENTS OF THE INVENTION

Figure 1:
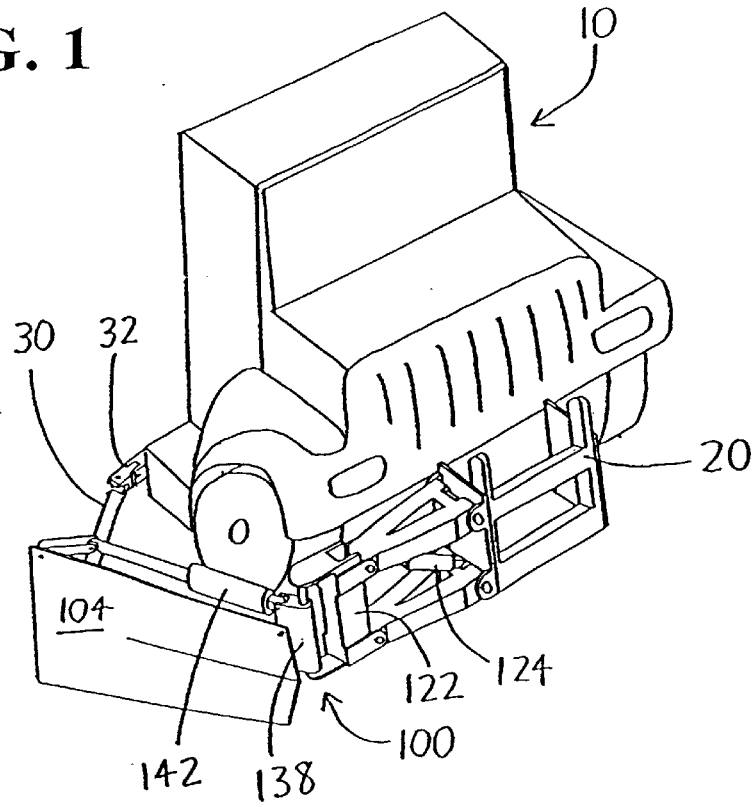
FIG. 1 is a front perspective view of a portion of a plowing vehicle 10 including a front moldboard frame 20 (the front moldboard being removed), with an exemplary wing plow assembly 100 (including wing plow 104) extending from the moldboard frame 20 and a rear shock bar 30 extending between the wing plow 104 and the plowing vehicle 10.

Referring to FIG. 1, the front portion of a plowing vehicle 10 is shown with a front moldboard frame 20 provided at the middle of the front of the vehicle 10. The moldboard frame 20 may be affixed to a front moldboard and/or to the moldboard's reversing table (i.e., the pivoting arrangement allowing "steering" of the front moldboard), but these components are not illustrated in FIG. 1. It should be understood that the moldboard frame 20 illustrated in FIG. 1 merely has an exemplary configuration, and that moldboard frames compatible with the invention (the wing plow assembly and the various subassemblies and components thereof) may take a variety of forms other than the one shown. An exemplary version of the invention, which is overall depicted at 100 throughout the figures, will now be discussed in detail.

The wing plow assembly 100 initially includes a lift subassembly 102 which enables vertical lifting of wing plow 104. The lift subassembly 102 includes a base member 106 which is adapted to be fixed to the plowing vehicle 10, or as in the case illustrated in FIG. 1, to structures (such as the moldboard frame 20) fixed to the plowing vehicle 10. Here, the base member 106 is depicted as including a base member mounting plate 108 which is welded to or otherwise affixed to the moldboard frame 20 in FIG. 1, and two pairs of oppositely-situated protruding base member ears 110, an upper pair and a lower pair. In versions of the invention wherein the base member mounting plate 108 is not included, the base member ears 110 might instead be affixed directly to the plowing vehicle 10, or to structures fixed to the plowing vehicle 10 such as the moldboard frame 20.

Two pairs of opposing base member pivots 112, an upper pair and a lower pair, are defined within the upper and lower pairs of base member ears 110. The base member pivots 112 within each pair are preferably at least substantially horizontally aligned to rest across a common axis, and the upper and lower base member pivots 112 are preferably aligned in at least substantially vertical relation, for reasons that will be apparent later in this document. The upper and lower pairs of base member pivots 112 respectively accommodate upper and lower height adjustment arms 114. Each height adjustment arm 114 has a fixed length extending between a base end 116 which is pivotally fixed to the base member ears 110 (and thus to the base member 106) at the base member pivots 112, and a plow end 118 wherein plow pivots 120 are defined.

Figure 2:
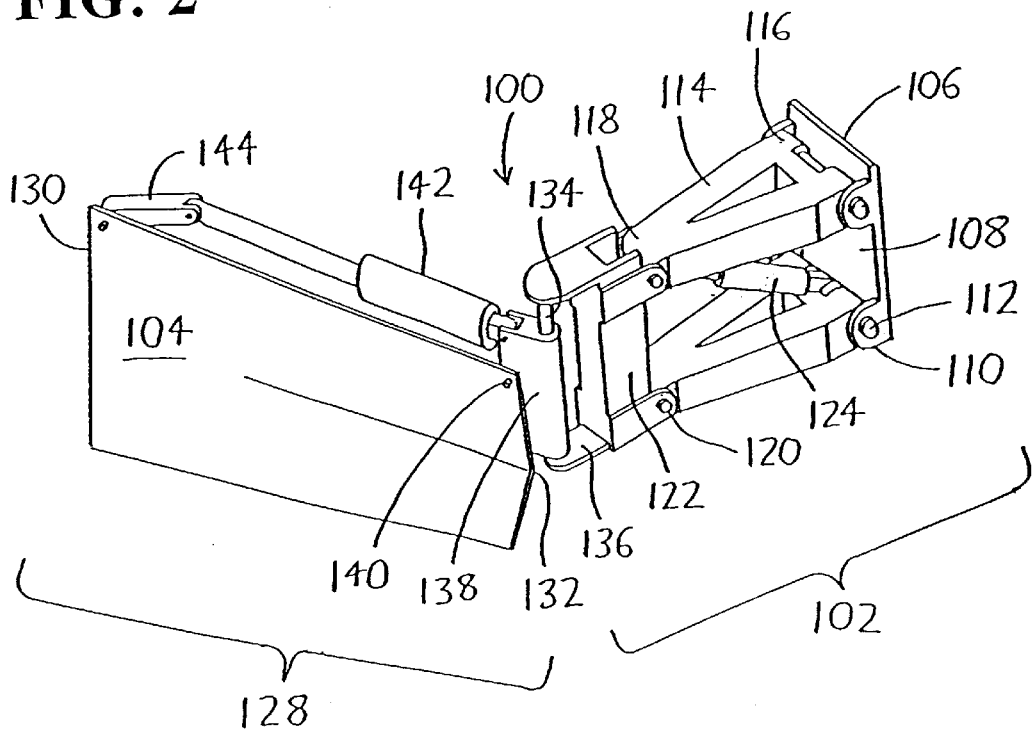
FIG. 2 is a front perspective view of the wing plow assembly 100 of FIG. 1 showing the lift subassembly 102 and the folding subassembly 128 of the wing plow assembly 100 in greater detail.

The upper and lower height adjustment arms 114 are preferably wider at the base member pivots 112 than at the plow pivots 120 (i.e., the height adjustment arms 114 preferably provide a greater bearing surface for the base member pivots 112 than the plow pivots 120), with a preferred configuration for the height adjustment arms 114 being the "A-frame" configuration particularly visible in FIGS. 1 and 2, wherein the base member pivots 112 are provided in the opposing legs of the "A," and the plow pivots 120 are defined in the peak of the "A." When the height adjustment arms 114 are formed in the A-frame configuration, they are preferably hollow (as by forming them of welded sections of steel plate or other metal) so that the height adjustment arms 114 achieve high strength without excessive weight.

A plow positioning leg 122 is then provided in a location spaced from the base member 106. When the plow positioning leg 122 assumes the form illustrated in the drawings, it may be formed of a length of metal I-beam with opposing upper and lower pairs of positioning leg ears 120 welded or otherwise affixed to the sides of the plow positioning leg 122 to extend towards the base member 106. The positioning leg ears 120 within each pair are preferably at least substantially horizontally aligned to rest across a common axis, and the upper and lower positioning leg ears 120 are preferably aligned in at least substantially vertical relation. The plow ends 118 of the height adjustment arms 114 are then pivotally affixed to the positioning leg ears 120 of the plow positioning leg 122 at the plow pivots 120. As a result, the base member 106, height adjustment arms 114, and plow positioning leg 122 form a linkage wherein the various members of the linkage may pivot in relation to their adjacent members, but the height adjustment arms 114 are constrained to always rest in parallel relation between their base member pivots 112 and plow pivots 120, and the plow positioning leg 122 is always constrained to move in parallel relation to the base member 106 between the base member pivots 112 and plow pivots 120. Thus, the height adjustment arms 114 are pivotally anchored with respect to the base member 106 (and thus to the plowing vehicle 10) at their base ends 116 so that they will (when actuated) swing in parallel relation.

Figure 3:
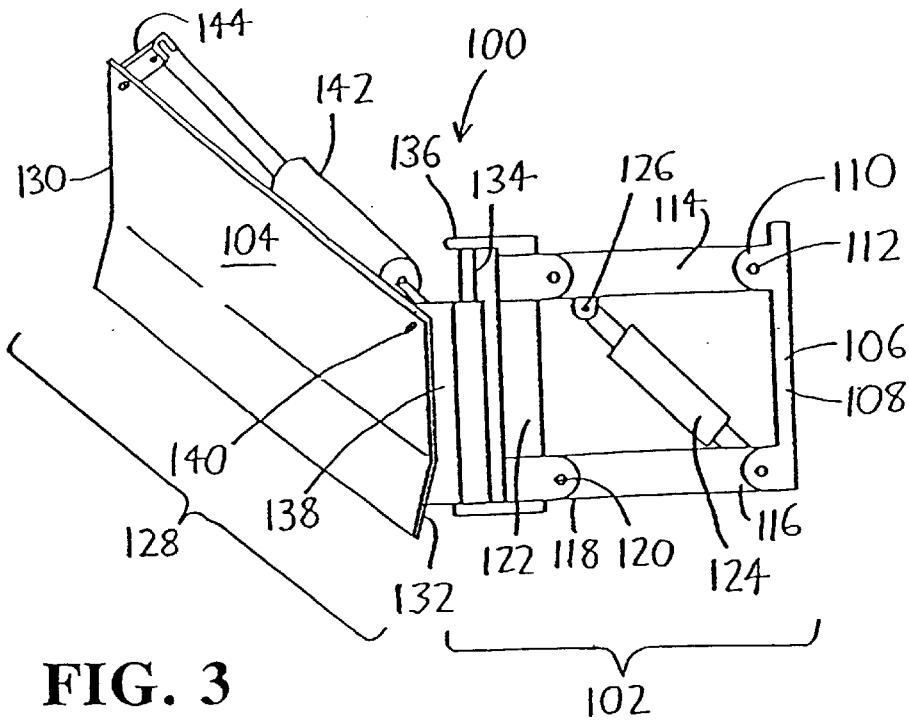
FIG. 3 is a front perspective view of the wing plow assembly 100 of FIGS. 1 and 2 viewing the lift subassembly 102 from a vertical plane located in front of the subassembly 102, with the wing lift linear actuator 124 of the lift subassembly 102 shown retracted so that the plow positioning leg 122 (and the folding subassembly 128) is in its lowermost position, and with the wing fold linear actuator 142 of the folding subassembly 128 shown partially extended so that the wing plow 104 is partially unfolded.

A wing lift linear actuator 124 then extends between the upper and lower height adjustment arms 114, and between the base member 106 and plow positioning leg 122, with the wing lift linear actuator 124 being extendable and contractible along its length to move the plow positioning leg 122 about the base member 106. The wing lift linear actuator 124 preferably takes the form of one or more hydraulic cylinders, though pneumatic, electromagnetic, mechanical (e.g., screw actuated), or other types of actuators may be used instead. A preferred arrangement is to have the wing lift linear actuator 124 pivotally mounted to the base member pivots 112 at which the base member 106 is pivotally fixed to the lower height adjustment arm 114, to extend to (and be pivotally joined to) the upper height adjustment arm(s) 114. This arrangement can be best seen in FIGS. 1 and 2, wherein the wing lift linear actuator 124 has one end pivotally mounted between the legs of the A-frame of the lower height adjustment arm 114 at the base member pivot 112 of the lower height adjustment arm 114, to extend upwardly to be pivotally linked to an upper arm actuator pivot 126 on the upper height adjustment arm 114 (see particularly FIGS. 3 and 4). Thus, when the wing lift linear actuator 124 is extended, the plow positioning leg 122 is raised upwardly and the horizontal distance between the plow positioning leg 122 and the base member 106 decreases. By having the wing lift linear actuator 124 extend upwardly from a location near the bottom of the base member 106 (e.g., from the base member pivot 112 of the lower height adjustment arm 114), the portion of the wing lift linear actuator 124 situated nearer to the plowing surface (the roadway or other surface to be plowed) is located away from the lower end of the plow positioning leg 122, which is near the front corner of the plowing vehicle 10 when the plow positioning leg 122 is lowered and is thus more likely to encounter unplowed snow or other roadway objects. Thus, the foregoing arrangement is more useful to minimize damage to the wing lift linear actuator 124.

The lift subassembly 102 thus allows vertical lifting of the plow positioning leg 122, and thus the wing plow 104, which is preferably attached to the plow positioning leg 122 using an arrangement to be discussed shortly. It is then useful to also have the wing plow assembly 100 also include a folding subassembly 128 which allows folding of the wing plow 104 with respect to the lift subassembly 102 and the plowing vehicle 10. A preferred arrangement for the folding subassembly 128 is as follows.

The wing plow 104, which has a outer end 130 distant from the plow positioning leg 122 and a inner end 132, is preferably both pivotally and translatably mounted to the plow positioning leg 122. In the preferred version of the invention depicted by the wing plow assembly 100, this is done by providing a wing positioning bar 134, which may be considered to be a component of both the folding subassembly 128 and the lift subassembly 102. The wing positioning bar 134 is preferably provided in the form of a tube or rod, in a vertical orientation with its ends fixed to a pair of positioning bar ears 136 protruding from the top and bottom sides of the plow positioning leg 122. Provided the base member 106, height adjustment arms 114, and plow positioning leg 122 linkage operates as described above, the wing positioning bar 134 will remain constrained in an at least substantially vertical orientation when the height adjustment arms 114 swing.

A wing plow anchor 138, which may also be considered to be a component of both the folding subassembly 128 and the lift subassembly 102, is then both slidably and pivotally mounted to the plow positioning leg 122 by extending the wing positioning bar 134 through it. This allows the wing plow anchor 138 to rotate about the wing positioning bar 134 in a horizontal plane and also translate along the wing positioning bar 134 in a vertical direction along the wing positioning bar 134 and parallel to the plow positioning leg 122. The inner end 132 of the wing plow 104 is then pivotally mounted to the wing plow anchor 138 at a plow pivot 140. Thus, apart from being both pivotally and translatably movable about the wing positioning bar 134, the inner end 132 of the wing plow 104 is pivotally movable in a vertical plane about the plow pivot 140.

The folding subassembly 128 then includes a wing fold linear actuator 142 interposed between the wing plow anchor 138 and the outer end 130 of the wing plow 104. A preferred arrangement (as depicted in the drawings) is to have the wing fold linear actuator 142 pivotally linked to a portion of the wing plow anchor 138 with its length extending towards the inner end 132 of the wing plow 104. Near the inner end 132, the wing fold linear actuator 142 can be joined to the wing plow 104 via a tilting link 144, which is pivotally fixed to both the wing fold linear actuator 142 and to the outer end 130 of the wing plow 104. By providing this tilting link 144, the outer end 130 undergoes a more significant degree of vertical travel when the wing fold linear actuator 142 is extended and retracted. The tilting link 144 is coaxial (or nearly so) with the wing fold linear actuator 142 when the wing fold linear actuator 142 is more fully retracted (FIG. 4), with the wing plow 104 being more fully situated in its folded position (with the outer end 130 being situated closer to the plow vehicle 10 at a greater vertical height). When the wing fold linear actuator 142 is more fully extended (FIG. 3), the tilting link 144 is at a greater angle to the axis of the wing fold linear actuator 142, and the resulting "slack" between the wing plow anchor 138 and the outer end 130 of the wing plow 104 situates the outer end 130 more distantly from the plowing vehicle 10 at a lower height. Thus, the wing plow 104 may be folded and unfolded from the plowing vehicle 10 solely by use of the wing fold linear actuator 142 of the folding subassembly 128, and no other actuators are needed to drive the wing plow 104 between its unfolded (FIG. 3) and folded (FIG. 4) positions.

Figure 4:
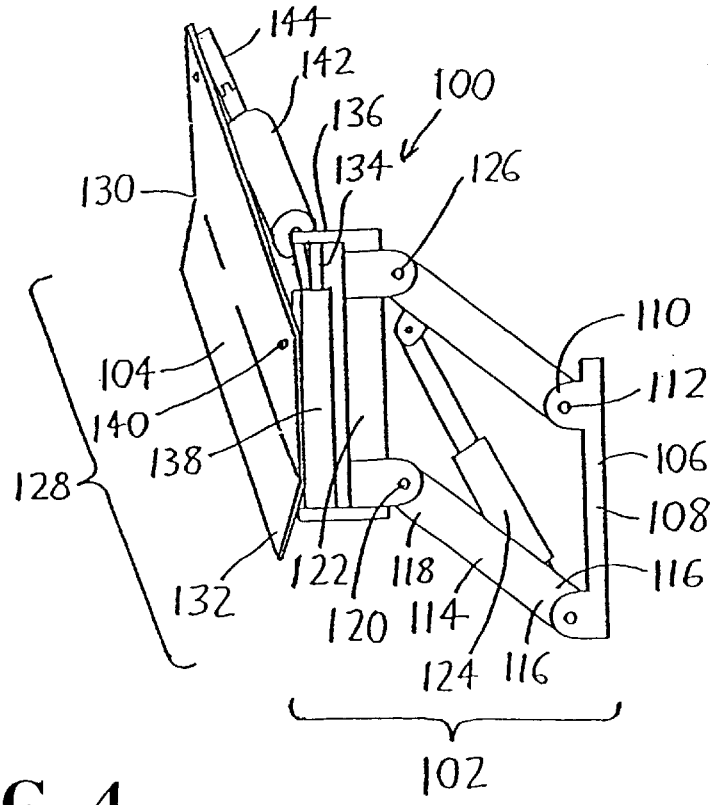
FIG. 4 is a front perspective view of the wing plow assembly 100 of FIGS. 2 and 3 shown with the wing fold linear actuator 142 fully retracted to situate the wing plow 104 in its folded position, and the wing lift linear actuator 124 fully extended to lift the plow positioning leg 122 and wing plow 104.

Additionally, the wing lift linear actuator 124 of the lift subassembly 102 allows the wing plow 104 to be lifted vertically into the air (as depicted in FIG. 4) to clear objects along the roadway when the operator desires. While FIG. 4 depicts the plow positioning leg 122 in its lifted position with the wing plow 104 in its folded state, it may be lifted when the wing plow 104 is unfolded as well. When the wing plow 104 is both folded and lifted (as in FIG. 4), it rests closely adjacent to the side of the plowing vehicle 10. When the plow positioning leg 122 is in its lowered position (FIG. 3), it slightly spaces the wing plow 104 further outwardly from the side of the plowing vehicle 10, which is extremely useful to allow access to the hood of the plowing vehicle 10 for maintenance purposes.

It is preferable to have the lift subassembly 102 and the folding subassembly 128 operate independently, i.e., to have the wing lift linear actuator 124 perform its lifting function entirely independently of the folding function performed by the wing fold linear actuator 142 (and conversely, it is preferable to have the wing fold linear actuator 142 be the only linear actuator which is needed to fold the wing plow 104 with respect to the plow positioning leg 122). This is beneficial because when the actuators 124 and 142 are provided by hydraulic cylinders, each actuator is conventionally operated in the plowing vehicle's cab by its own lever. If an operator was required to actuate more than one cylinder in order to perform either of the lifting or folding functions, it would be difficult for the plow operator to appropriately control two levers while reserving a hand free for operation of the steering wheel of the plowing vehicle 10. Thus, by use of the preferred arrangement wherein the actuators 124 and 142 are independent, the user may steer the plowing vehicle 10 with one hand and may (1) operate one lever to actuate the wing fold linear actuator 142 and fold the wing plow 104, or (2) operate a different lever to actuate the wing lift linear actuator 124 and lift the plow positioning leg 122 and the wing plow 104. Conveniently, levers may be situated adjacent each other in the cab of the plowing vehicle 10, and may be arranged such that if the wing plow 104 needs to be folded inwardly and lifted at the same time in an emergency situation, both levers may simply be flipped in the same direction to accomplish this result.

Note that no actuator drives the wing plow anchor 138 and wing plow 104 vertically along the wing positioning bar 134. Rather, the wing plow anchor 138 is merely allowed to "float" on the wing positioning bar 134, allowing the wing plow 104 to raise and lower as the wing plow 104 rides upon the roadway and follows its contour. If desired, an actuator could be provided to allow lifting of the wing plow anchor 138 along the wing positioning bar 134. Alternatively, the wing plow anchor 138 could be driven along the wing positioning bar 134 via remote actuation; for example, a cable could affix to the top of the wing plow anchor 138, and could extend through a pulley or other low-friction support at or near the upper positioning leg ear 120, to a cable actuator provided somewhere on or near the lift subassembly 102 or the moldboard frame 20. The advantage of this arrangement is that if the wing plow 104 (and wing plow anchor 138) are suddenly forced upwardly, the cable would simply go slack, whereas if it is desired to pull the wing plow anchor 138 and wing plow 104 upwardly, the operator of the plow vehicle 10 can simply actuate the cable actuator to draw in the cable and pull the wing plow anchor 138 upwardly.

As previously noted, the wing lift linear actuator 124 preferably extends upwardly from a pivotal mounting at a location near the bottom of the base member 106 to a pivotal mounting at a location near the upper positioning leg ear 120. While other arrangements are possible—e.g., having the wing lift linear actuator 124 extend upwardly from a pivotal mounting at a location near the lower positioning leg ear 120 to a pivotal mounting at a location near the upper mounting plate ears 110—a benefit of the preferred arrangement is that it allows lifting of the plow positioning leg 122 via extension of the wing lift linear actuator 124 (compare FIGS. 3 and 4) rather than via retraction. This is useful where hydraulic cylinders are used for the wing lift linear actuator 124 since hydraulic cylinders have greater strength in extension, and thus the plow positioning leg 122 may be more easily and speedily lifted when desired. Another benefit of having the wing lift linear actuator 124 lift the plow positioning leg 122 and wing plow 104 via extension rather than retraction is that in the event of the wing plow 104 encountering a sudden extreme upward shock (as when the wing plow 104 encounters a highly raised portion of the road), the plow positioning leg 122 may be forced upwardly with extreme force, which could damage the wing lift linear actuator 124 if it was suddenly forced to retract. In contrast, the hydraulic circuit for the wing lift linear actuator 128 can be designed to accommodate sudden extension of the wing lift linear actuator 128 in the event the plow positioning leg 122 was suddenly thrown upwardly: the circuit can include a one-way valve leading to a hydraulic reservoir, such that when the piston of the wing lift linear actuator 128 draws a vacuum within the cylinder, the cylinder will draw oil from the reservoir. Thus, the lifting subassembly 102 can effectively provide "float" beyond that provided by the wing positioning bar 134 so that damage to the wing plow 104, and/or the transmission of excessive shock to the plowing vehicle 10, can be avoided when the wing plow 104 is suddenly forced upwardly.

While it was noted previously that the wing fold linear actuator 142 is preferably the only actuator used to effect folding of the wing plow 104 with respect to the lifting subassembly 102, since the wing fold linear actuator 142 would be subject to significant shock loading if it alone supported the wing plow 104 in its position unfolded from the plow vehicle 10, it is useful to include a rear shock bar 30 extending between the plowing vehicle 10 and the outer end 130 of the wing plow 104 (as illustrated in FIG. 1). The rear shock bar 30 has universal joints 32 at its opposing ends, with the universal joints 32 joining the rear shock bar 30 to the wing plow 104 and to the plowing vehicle 10, so that the rear shock bar 30 may readily travel with the wing plow 104 as it is folded and unfolded by the wing fold linear actuator 142. The rear shock bar 30 is preferably provided with at least a small degree of shock-absorbing capability by making it axially elastically compressible over at least a portion of its length, e.g., by providing a portion of its length as an enclosed compression spring, pneumatic shock absorber, or some other structure which allows the length of the rear shock bar 30 to elastically elongate and compress without allowing the rear shock bar 30 to substantially bend from a linear configuration. Thus, while the rear shock bar 30 may fold at its universal joints 32 or may axially compress or elongate, it cannot bend, and it will therefore provide a support which helps to maintain the wing plow 104 in its outwardly-folded position when the wing fold linear actuator 142 locates it in this position.

It is understood that the various preferred versions of the invention are shown and described above to illustrate different possible features of the invention and the varying ways in which these features may be combined. Apart from combining the different features of the foregoing versions in varying ways, other modifications are also considered to be within the scope of the invention. Following is an exemplary list of such modifications.

Initially, it is not necessary that the height adjustment arms 114 have the A-frame configuration illustrated in the accompanying drawings, though it is preferable that at least the upper height adjustment arm 114 has the A-frame configuration (or some other reinforced configuration). This is because the use of only the single wing fold linear actuator 142 to effect folding of the wing plow 104 tends to apply significant loading to the plow positioning leg 122 when the wing plow 104 is folded upwardly, with the top of the plow positioning leg 122 being pulled rearwardly. As a result, high moment forces are exerted along the length of the plow positioning leg 122. The use of a reinforced upper height adjustment arm 114 decreases the need for further reinforcement of the plow positioning leg 122 and wing positioning bar 134, and additionally it protects the wing lift linear actuator 128, which is susceptible to damage from forces exerted off of its axis. As an alternative (or additional) measure, more than two height adjustment arms 114 may be used.

The wing lift linear actuator 124 may be affixed between different members of the parallelogram linkage provided by the base member 106, height adjustment arms 114, and plow positioning leg 122, and it need not be provided within the interior of the parallelogram linkage (e.g., it could rest above the upper one of the height adjustment arms 114 and extend therefrom to structure fixed in relation to the base member 106).

The "float" provided by the excess length of the wing positioning bar 134 may be eliminated so that the wing plow anchor 138 merely pivots upon the wing positioning bar 134, with all float being provided by the lift subassembly 102 (though this is not a preferred arrangement). It is also possible to effectively combine the wing positioning bar 134 and the plow positioning leg 122 in a single structure, i.e., have the wing plow anchor 138 pivot and/or rotate upon the plow positioning leg 122 (which would preferably have a cylindrical configuration to ease pivoting of the wing plow anchor 138 thereon). In this case, a separate wing positioning bar 134 would be unnecessary. However, if this modification is pursued, it may be useful to reinforce the plow positioning leg 122 to avoid bending or failure, or perhaps to add another vertical link to the height adjustment arms 114 (in addition to the base member mounting plate 108 and the plow positioning leg 122) to add rigidity to the linkage.

It is possible to utilize some arrangement other than the wing fold linear actuator 142 and tilting link 144 to achieve folding of the wing plow 104, such as by using an actuator in place of the rear shock bar 30. However, as previously noted, such an arrangement would generate interdependence between the lifting and folding features of the wing plow 104, and it is generally believed to be preferable to allow independent control of lifting and folding features.

The wing fold linear actuator 142 (and tilting link 144, if included) may extend from the wing plow outer end 130 to structures on the wing plow assembly other than the wing plow anchor 138, such as to the plow positioning leg 122 or associated structure (with the juncture between the wing fold linear actuator 142 and the plow positioning leg 122 perhaps being provided by a universal joint or other articulated structure which can accommodate any pivoting and/or translation of the wing plow 104 with respect to the plow positioning leg 122).

Rather than having the tilting link 144 affixed to the wing plow outer end 130 and the wing fold linear actuator 142 affixed to the wing plow inner end 132, their positions could be reversed, and the tilting link 144 could be affixed to the wing plow inner end 132 with the wing fold linear actuator 142 affixed to the wing plow outer end 130. However, this arrangement may not be recommended if the wing fold linear actuator 142 would then have greater potential exposure to damage (as will generally be the case where the wing fold linear actuator 142 is situated farther from the plow positioning leg 122).

If desired, more than one wing lift linear actuator 128 and/or wing fold linear actuator 142 could be used. The wing fold linear actuator 142 could be eliminated if desired, and the folding of the wing plow 104 could instead be actuated by (for example) an actuator in place of the rear shock bar 30, but actuators extending from the wing plow outer end 130 to the plowing vehicle 10 or associated structure are preferably avoided for reasons noted earlier.

The base member 106 need not include the mounting plate 108, and the base member 106 can merely be provided in the form of ears or similar pivot anchors formed in or provided on a moldboard frame 20 or on a plowing vehicle 10.

It is useful to utilize elastic bushings, such as those discussed in U.S. Pat. No. 6,408,547 (which has the inventors of the present invention in common), within the mounting plate base pivots 112, the plow pivots 120, and the upper arm actuator pivot 126. Such bushings, which help to diminish the damaging effect of shock loading, are particularly useful at the foregoing pivots of the wing plow assembly, though they may also be useful in other pivots situated about the assembly (it being noted that not all such pivots were specifically mentioned or discussed in detail above).

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A wing plow assembly comprising:

a. a base member configured to be affixed to a plowing vehicle or to structures affixed to a plowing vehicle, the base member being oriented at least substantially vertically;

b. a wing positioning bar constrained to move parallel to the base member;

c. an extendable wing lift actuator provided between the base member and the wing positioning bar;

d. a wing plow anchor slidably mounted on the wing positioning bar;

e. a wing plow having a outer end and a inner end, the inner end being pivotally affixed with respect to the wing plow anchor;

f. an extendable wing fold actuator extending from the wing plow anchor to the outer end of the wing plow, whereby the wing lift actuator may be actuated to move the wing positioning bar and thereby move the wing plow anchor and wing plow with respect to the base member, and the wing fold actuator may be actuated to move the wing plow with respect to the wing positioning bar.

2. The wing plow assembly of claim 1 further comprising a pair of fixed-length height adjustment arms which pivot in parallel relation between the base member and the wing positioning bar.

3. The wing plow assembly of claim 2 wherein:

a. the height adjustment arms each extend between a base end and a plow end, each base end defining a base pivot situated at or adjacent to the base member and each plow end defining a plow pivot situated adjacent the wing plow, and b. at least one of the height adjustment arms is wider at its base pivot than at its plow pivot.

4. The wing plow assembly of claim 2 wherein:

a. the height adjustment arms include upper and lower adjustment arms, each extending between a base end and a plow end, wherein each base end defines a base pivot situated at or adjacent to the base member and each plow end defines a plow pivot situated adjacent the wing plow, and b. the wing lift actuator extends from the base pivot of the lower adjustment arm.

5. The wing plow assembly of claim 1 wherein the wing lift actuator extends upwardly from a lower portion of the base member towards the wing positioning bar.

6. The wing plow assembly of claim 1 wherein elongation of the wing lift actuator moves the wing positioning bar nearer to the base member.

7. The wing plow assembly of claim 1 wherein the wing fold actuator is the only actuator which moves the wing plow with respect to the wing positioning bar.

8. The wing plow assembly of claim 1 wherein:

a. the wing positioning bar is provided on a plow positioning leg, the plow positioning leg including a pair of spaced leg pivot points thereon, and b. a pair of fixed-length height adjustment arms extend from the leg pivot points to a pair of spaced base pivot points on the base member.

9. The wing plow assembly of claim 1 in combination with a plowing vehicle, wherein no actuator extends between the outer end of the wing plow and the plowing vehicle.

10. A wing plow assembly comprising:

a. upper and lower height adjustment arms, each height adjustment arm having a fixed length extending between a base end and a plow end, wherein the height adjustment arms are pivotally anchored with respect to a plowing vehicle at their base ends to swing vertically in parallel relation;

b. a plow positioning leg having the plow ends of the height adjustment arms pivotally affixed thereon in spaced relationship;

c. a wing plow anchor slidably mounted to the plow positioning leg;

d. a wing fold actuator extending from the wing plow anchor;

e. a wing plow having a outer end and a inner end, the inner end being connected to the wing plow anchor and the outer end being connected to the wing fold actuator.

11. The wing plow assembly of claim 10 wherein at least one of the height adjustment arms has its base end wider than its plow end.

12. The wing plow assembly of claim 10 wherein:

a. the plow positioning leg includes a wing positioning bar upon which the wing plow anchor slides;

b. the wing positioning bar is constrained to remain in an at least substantially vertical orientation when the height adjustment arms swing.

13. The wing plow assembly of claim 10 further comprising a wing lift actuator pivotally anchored to the lower height adjustment arm, wherein actuation of the wing lift actuator causes the height adjustment arms to swing vertically.

14. The wing plow assembly of claim 13 wherein the wing lift actuator is pivotally anchored to the base end of the lower height adjustment arm.

15. The wing plow assembly of claim 10 wherein the wing fold actuator is the only actuator which moves the wing plow with respect to the plow positioning leg.

16. A wing plow assembly comprising:

a. a base member adapted for mounting to a plowing vehicle or to structures connected to a plowing vehicle;

b. a plow positioning leg spaced from the base member;

c. upper and lower height adjustment arms, each height adjustment arm having a fixed length extending between a base end and a plow end, wherein the height adjustment arms are:

i. pivotally anchored to the base member at their base ends, and ii. pivotally anchored to the plow positioning leg at their plow ends, wherein the height adjustment arms swing in parallel relation to move the plow positioning leg with respect to the base member;

d. a wing plow anchor slidably mounted to the plow positioning leg;

e. a wing plow having a outer end and a inner end, the inner end being pivotally movable with respect to the wing plow anchor;

f. a wing fold actuator extending between the wing plow anchor and the outer end of the wing plow.

17. The wing plow assembly of claim 16 wherein at least one of the height adjustment arms is wider at its base end than at its plow end.

18. The wing plow assembly of claim 16 further comprising a wing lift actuator pivotally anchored to at least one of the height adjustment arms, the wing lift actuator being extendible and contractible to swing the height adjustment arms in parallel relation.

19. The wing plow assembly of claim 16 further comprising a wing lift actuator pivotally anchored to the base end of the lower height adjustment arm, the wing lift actuator being extendible and contractible to swing the height adjustment arms in parallel relation.

20. The wing plow assembly of claim 16 wherein the wing fold actuator is the only actuator which moves the wing plow with respect to the plow positioning leg.

21. A wing plow assembly comprising:

a. a base member adapted for mounting to a plowing vehicle or to structures connected to a plowing vehicle;

b. upper and lower height adjustment arms, each height adjustment arm having a fixed length extending between a base end and a plow end, wherein:

(1) the height adjustment arms are pivotally anchored with respect to a plowing vehicle at their base ends to swing in parallel relation, and (2) at least one of the height adjustment arms is wider at its base end than at its plow end;

c. a plow positioning leg having the plow ends of the height adjustment arms pivotally anchored thereon;

d. a wing lift actuator extending between the upper and lower height adjustment arms, the wing lift actuator being extendible and contractible to move the plow positioning leg about the base member;

e. a wing plow having a outer end and a inner end, the inner end being pivotally movable with respect to the plow positioning leg;

f. a wing fold actuator extending from the outer end of the wing plow, the wing fold actuator being extendible and contractible to move the wing plow about the plow positioning leg.

22. The wing plow assembly of claim 21 further comprising a wing plow anchor slidably mounted to the plow positioning leg, wherein the inner end of the wing plow is pivotally linked to the wing plow anchor.

23. The wing plow assembly of claim 21 further comprising:

a. a wing positioning bar connected to the plow positioning leg, wherein the wing positioning bar is constrained to remain in an at least substantially vertical orientation, and b. a wing plow anchor slidably mounted on the wing positioning bar, wherein the inner end of the wing plow is pivotally linked to the wing plow anchor.

24. The wing plow assembly of claim 21 wherein the wing lift actuator is pivotally anchored at the base end of the lower height adjustment arm.

25. The wing plow assembly of claim 21 wherein the wing fold actuator is the only actuator which moves the wing plow about the plow positioning leg.

26. A wing plow assembly comprising:

a. a base member adapted for mounting to a plowing vehicle or to structures connected to a plowing vehicle;

b. upper and lower height adjustment arms, each height adjustment arm having a fixed length extending between a base end and a plow end, wherein the height adjustment arms are pivotally anchored with respect to a plowing vehicle at their base ends to swing in parallel relation;

c. a plow positioning leg having the plow ends of the height adjustment arms pivotally anchored thereon;

d. a wing lift actuator extending between the upper and lower height adjustment arms, the wing lift actuator being:

(1) pivotally anchored at the base end of the lower height adjustment arm, and (2) extendible and contractible to move the plow positioning leg about the base member;

e. a wing plow having a outer end and a inner end, the inner end being pivotally movable with respect to the plow positioning leg;

f. a wing fold actuator extending from the outer end of the wing plow, the wing fold actuator being extendible and contractible to move the wing plow about the plow positioning leg.

27. The wing plow assembly of claim 26 further comprising a wing plow anchor slidably mounted to the plow positioning leg, wherein the inner end of the wing plow is pivotally linked to the wing plow anchor.

28. The wing plow assembly of claim 26 further comprising:

a. a wing positioning bar connected to the plow positioning leg, wherein the wing positioning bar is constrained to remain in an at least substantially vertical orientation, and b. a wing plow anchor slidably mounted on the wing positioning bar, wherein the inner end of the wing plow is pivotally linked to the wing plow anchor.

29. The wing plow assembly of claim 26 wherein at least one of the height adjustment arms is wider at its base end than at its plow end.

30. The wing plow assembly of claim 26 wherein the wing fold actuator is the only actuator which moves the wing plow about the plow positioning leg.

* * * * *